US010953267B2

(12) United States Patent
Smith

(10) Patent No.: US 10,953,267 B2
(45) Date of Patent: Mar. 23, 2021

(54) EXERCISE MACHINE HAVING NON-MATCHED CABLE PAIRING

(71) Applicant: NAUTILUS, INC., Vancouver, WA (US)

(72) Inventor: Joshua S. Smith, Portland, OR (US)

(73) Assignee: Nautilus, Inc., Vancouver, WA (US)

( * ) Notice: Subject to any disclaimer, the term of this patent is extended or adjusted under 35 U.S.C. 154(b) by 36 days.

(21) Appl. No.: 16/082,409

(22) PCT Filed: Dec. 16, 2016

(86) PCT No.: PCT/US2016/067245
§ 371 (c)(1),
(2) Date: Sep. 5, 2018

(87) PCT Pub. No.: WO2017/116764
PCT Pub. Date: Jul. 6, 2017

(65) Prior Publication Data

US 2019/0076691 A1 Mar. 14, 2019

Related U.S. Application Data

(60) Provisional application No. 62/273,504, filed on Dec. 31, 2015.

(51) Int. Cl.
*A63B 21/005* (2006.01)
*A63B 23/035* (2006.01)
(Continued)

(52) U.S. Cl.
CPC ..... *A63B 21/154* (2013.01); *A63B 21/0058* (2013.01); *A63B 21/4035* (2015.10);
(Continued)

(58) Field of Classification Search
CPC ..... A63B 21/0051; A63B 21/0058; A63B 21/0084; A63B 21/0088; A63B 21/06;
(Continued)

(56) References Cited

U.S. PATENT DOCUMENTS 2,977,120 A * 3/1961 Morris ..... A63B 21/06 482/103
4,632,388 A * 12/1986 Schleffendorf ..... A63B 21/06 482/102
(Continued)

FOREIGN PATENT DOCUMENTS

CN 203899025 U 10/2014

*Primary Examiner* — Loan B Jimenez
*Assistant Examiner* — Zachary T Moore
(74) *Attorney, Agent, or Firm* — Dorsey & Whitney LLP

(57) ABSTRACT

An exercise machine having non-matched cable pairing is provided. The exercise machine may include a frame, a resistance element, at least a first plurality of corresponding engagement points and a second plurality of corresponding engagement points operatively associated with the frame, and first and second elongated flexible members routed through a pulley system. The first flexible member may be operably associated with the resistance element and may include opposing cable portions associated with and extending between one of the first plurality of corresponding engagement points and another engagement point not in the first plurality of corresponding engagement points. The second flexible member may be operably associated with the resistance element and may include opposing cable portions associated with and extending between another of the first plurality of corresponding engagement points and another engagement point not in the first plurality of corresponding engagement points.

31 Claims, 12 Drawing Sheets

(51) Int. Cl.

| | |
|---|---|
| ***A63B 23/12*** | (2006.01) |
| ***A63B 21/062*** | (2006.01) |
| ***A63B 21/008*** | (2006.01) |
| ***A63B 21/00*** | (2006.01) |

(52) U.S. Cl.
CPC .... *A63B 21/4043* (2015.10); *A63B 23/03541* (2013.01); *A63B 23/03566* (2013.01); *A63B 23/1209* (2013.01); *A63B 21/0051* (2013.01); *A63B 21/00065* (2013.01); *A63B 21/00069* (2013.01); *A63B 21/0084* (2013.01); *A63B 21/0088* (2013.01); *A63B 21/0628* (2015.10); *A63B 23/03525* (2013.01); *A63B 2225/093* (2013.01); *A63B 2225/10* (2013.01)

(58) Field of Classification Search
CPC ..... A63B 21/00065; A63B 21/00069; A63B 21/062; A63B 21/0628; A63B 21/15; A63B 21/151; A63B 21/152; A63B 21/4035; A63B 21/4043; A63B 23/03541; A63B 23/03566; A63B 23/1209; A63B 23/03525; A63B 2225/093; A63B 2225/10
USPC ..... 482/99, 102, 138; 254/399, 385
See application file for complete search history.

(56) References Cited

U.S. PATENT DOCUMENTS

| | | | | |
|---|---|---|---|---|
| 4,744,559 | A * | 5/1988 | Mahnke | A63B 21/06 482/99 |
| 5,518,477 | A | 5/1996 | Simonson | |
| 6,582,346 | B1 * | 6/2003 | Lines | A63B 21/154 482/102 |
| 6,705,976 | B1 * | 3/2004 | Piane, Jr. | A63B 21/154 482/102 |
| 6,976,941 | B2 * | 12/2005 | Britt | A63B 21/154 482/101 |
| 2004/0138032 | A1 * | 7/2004 | Van Straaten | A63B 21/00069 482/112 |
| 2006/0019804 | A1 * | 1/2006 | Young | A63B 21/154 482/93 |
| 2007/0167299 | A1 | 7/2007 | Simonson et al. | |
| 2008/0051263 | A1 | 2/2008 | Rasmussen et al. | |
| 2015/0182773 | A1 | 7/2015 | Olson et al. | |

* cited by examiner

EXERCISE MACHINE HAVING NON-MATCHED CABLE PAIRING

CROSS-REFERENCE TO RELATED APPLICATIONS

This application is the national stage application of International Patent Application No. PCT/US2016/067245 filed on Dec. 16, 2016 and entitled "Exercise Machine Having Non-Matched Cable Pairing" which claims priority to Provisional Patent Application No. 62/273,504 filed on Dec. 31, 2015 and entitled "Exercise Machine Having Non-Matched Cable Pairing", the entire contents of which are hereby incorporated by reference herein in their entireties.

TECHNICAL FIELD

The present disclosure relates generally to exercise machines, and more specifically to exercise machines with non-matched cable pairing.

BACKGROUND

Various fitness devices, such as exercise machines, exist to perform a variety of fitness exercises. These devices may be complex. Due to complexity, these devices can be expensive, hard to maintain and to use, unreliable, and nondurable.

It is therefore desirable to provide an improved exercise machine that addresses at least in part the above described problems and/or which more generally offers improvements or an alternative to existing arrangements.

SUMMARY

An exercise machine may include non-matched cable pairing for handles or other actuators operatively joined to a resistance element. The use of non-matched cable pairing allows for an increase in the travel distance of handles joined to non-matched cables when a user pulls on handles positioned at the same elevation on the exercise machine compared to machines in which handles at the same elevation are joined to opposing ends of a cable. Further, by providing multiple non-matched cables joined to handles or other actuators positioned at different elevations of the exercise machine, a user may perform exercises that require use of handles or other actuators at different elevations during a training routine without first repositioning the handles and actuators or associated cables and/or pulleys. By eliminating the need to reposition handles, cables, and/or pulleys, a user can move more quickly through a training routine. In this manner, the exercise machine may be easier to use compared to existing arrangements and may allow a user to more efficiently perform different exercises during a training session.

Embodiments of the present disclosure may include an exercise machine. The exercise machine may include a frame, a resistance element, at least a first plurality of corresponding engagement points and a second plurality of corresponding engagement points operatively associated with the frame, and first and second elongated flexible members routed through a pulley system operatively associated with the frame. The first flexible member may be operably associated with the resistance element and may include opposing cable portions associated with and extending between one of the first plurality of corresponding engagement points and another engagement point not in the first plurality of corresponding engagement points. The second flexible member may be operably associated with the resistance element and may include opposing cable portions associated with and extending between another of the first plurality of corresponding engagement points and another engagement point not in the first plurality of corresponding engagement points. Actuation forces applied to the cable portions of the first and second flexible members associated with the first plurality of corresponding engagement points may cause the first and second flexible members to extend from the first plurality of corresponding engagement points and actuate the resistance element.

Embodiments of the present disclosure may include an exercise machine. The exercise machine may include a frame including at least a first plurality of corresponding load engagement points and a second plurality of corresponding load engagement points, at least one cable operatively associated with a resistance element and including opposing cable portions operably associated with and extending between load engagement points not in the same plurality of corresponding load engagement points such that the opposing cable portions of the at least one cable are positioned at different levels of the frame. The resistance element may be operable to resist movement of the at least one cable.

Embodiments of the present disclosure may include an exercise machine. The exercise machine may include a frame including a platform and a framework forming a column extending vertically from the platform, a first pair of corresponding engagement points associated with the column, a second pair of corresponding engagement points associated with the column, a third pair of corresponding engagement points associated with the platform, a plurality of cables, and a resistance element operably associated with the plurality of cables to resist extension of any of the plurality of cables. The second pair of corresponding engagement points may be positioned between the first and third pairs of corresponding engagement points. Each cable may be operably associated with two of the first, second, and third pairs of corresponding engagement points such that the terminal ends of each cable are not associated with the same pair of corresponding engagement points.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
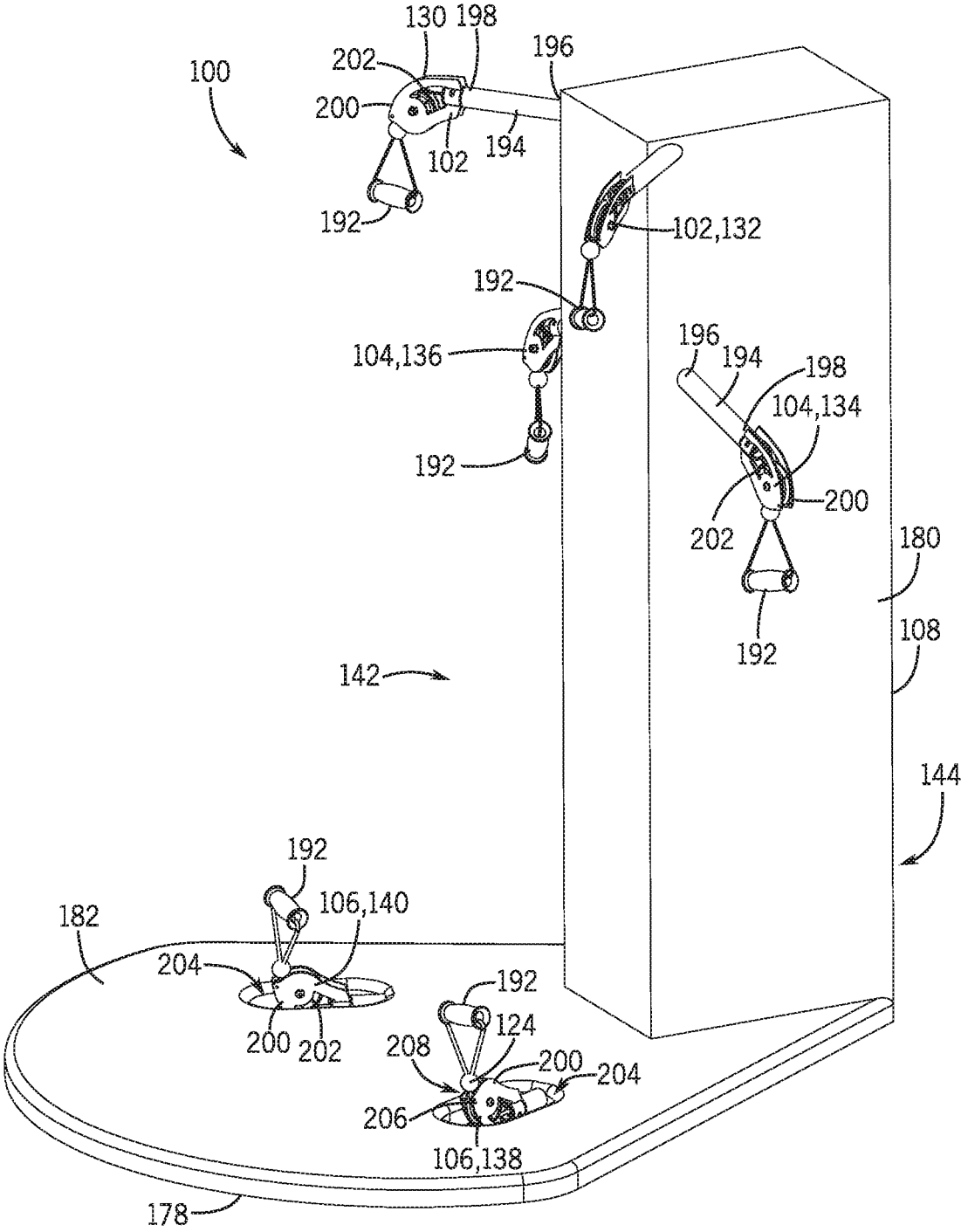
FIG. 1 is a top, front isometric view of an exercise machine.
Figure 2:
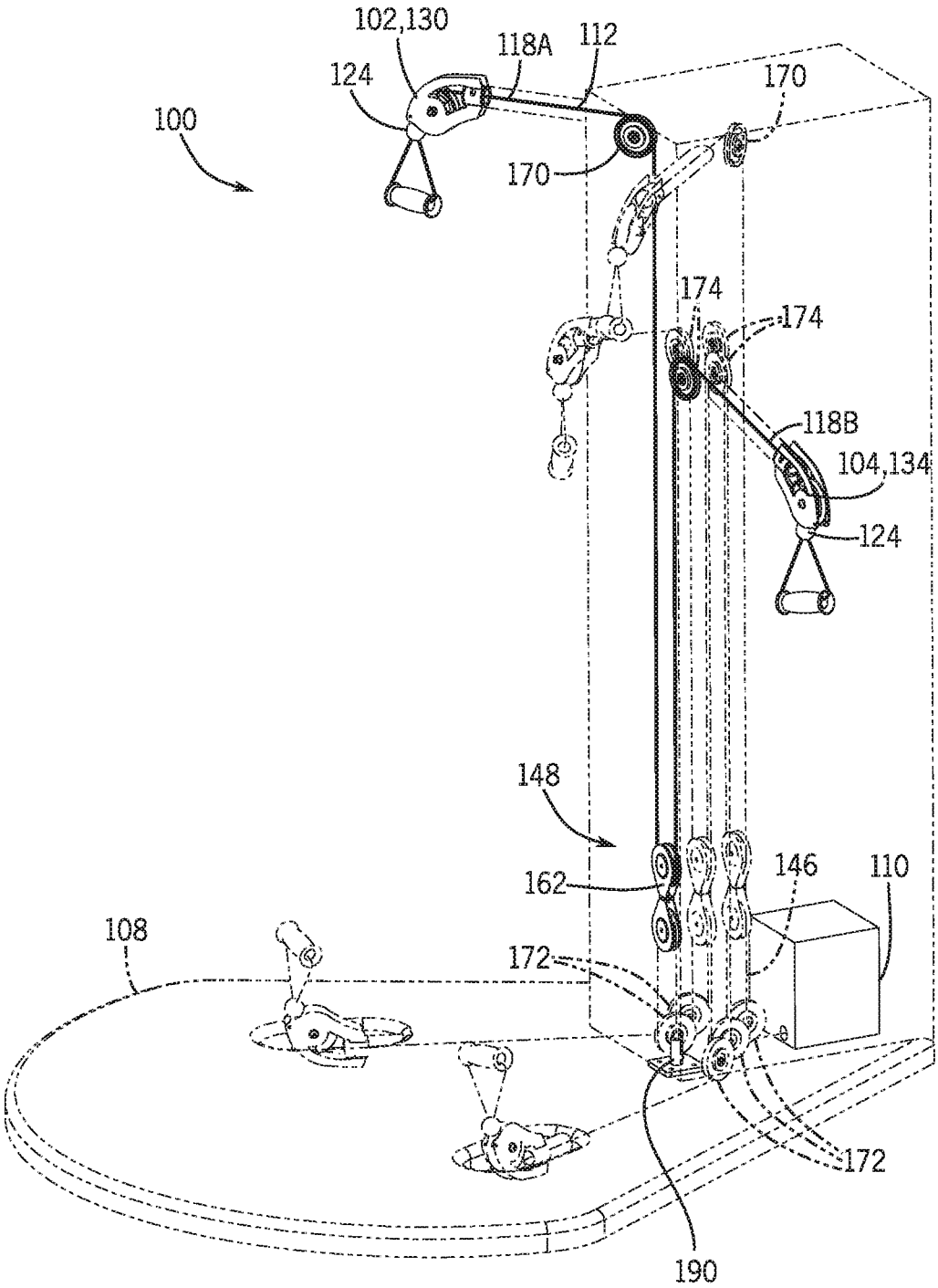
FIG. 2 is another isometric view of the exercise machine of FIG. 1.
Figure 3:
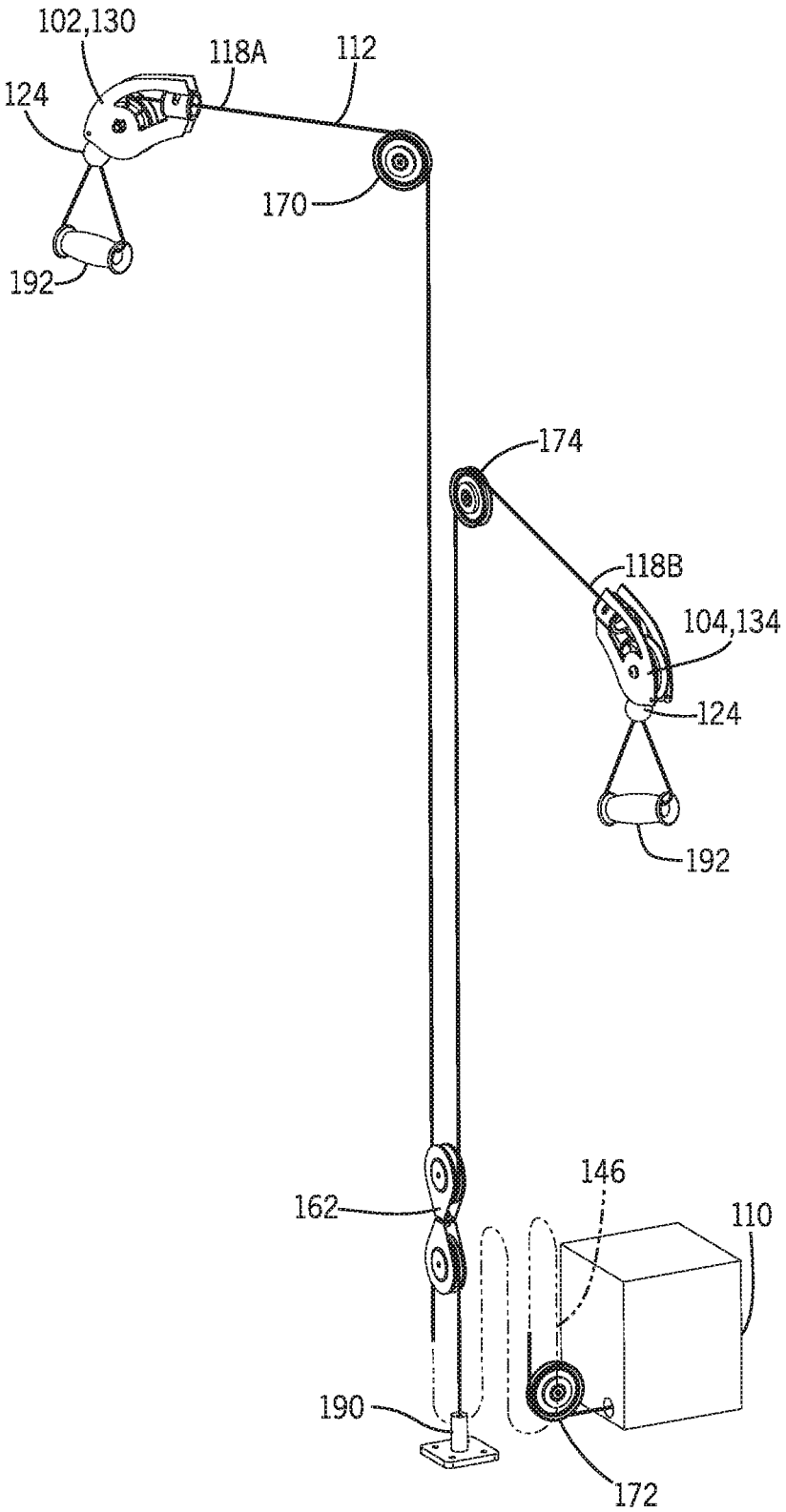
FIG. 3 is an isometric view of the routing of the cable member highlighted in FIG. 2 with other features removed for clarity.
Figure 4:
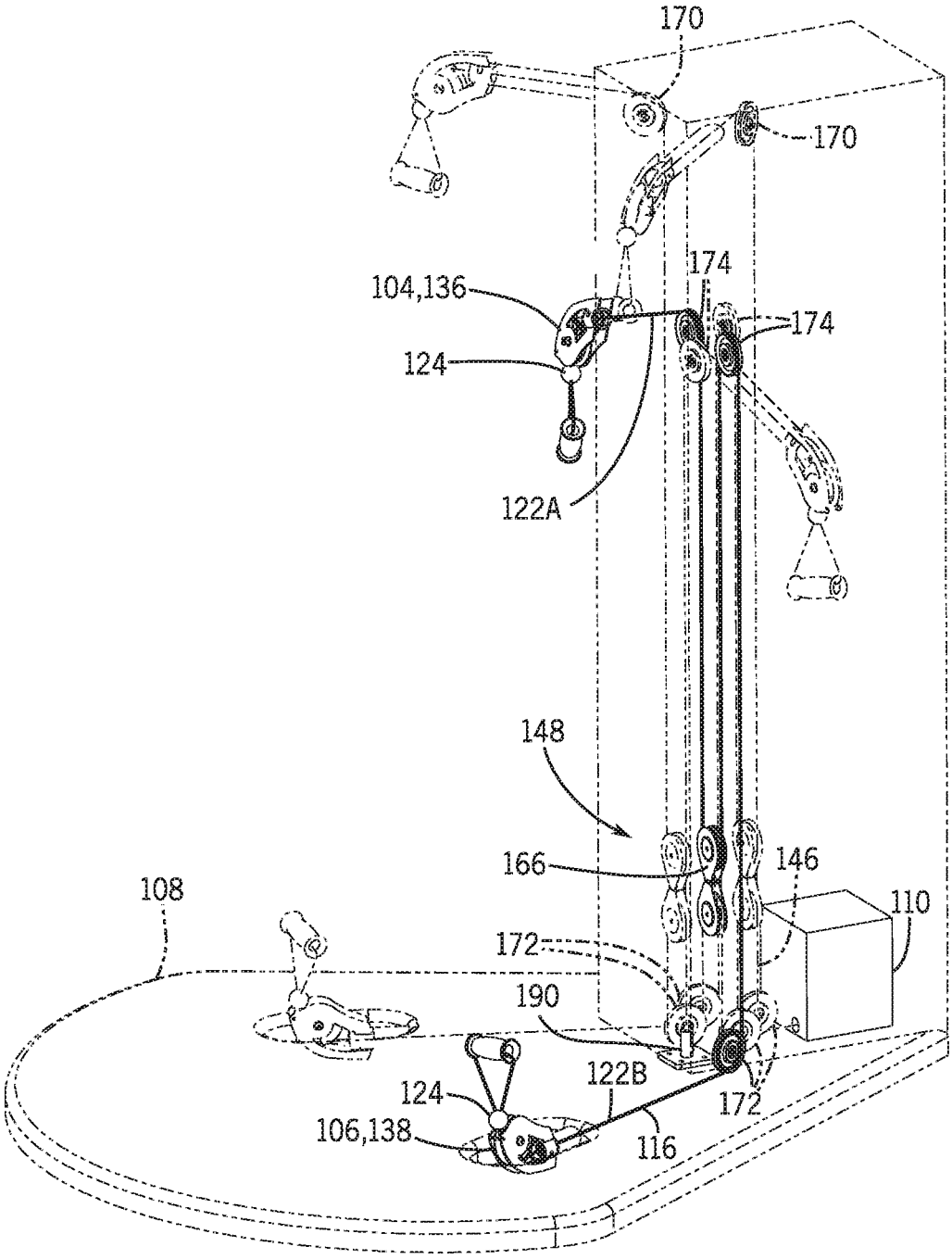
FIG. 4 is another isometric view of the exercise machine of FIG. 1.
Figure 5:
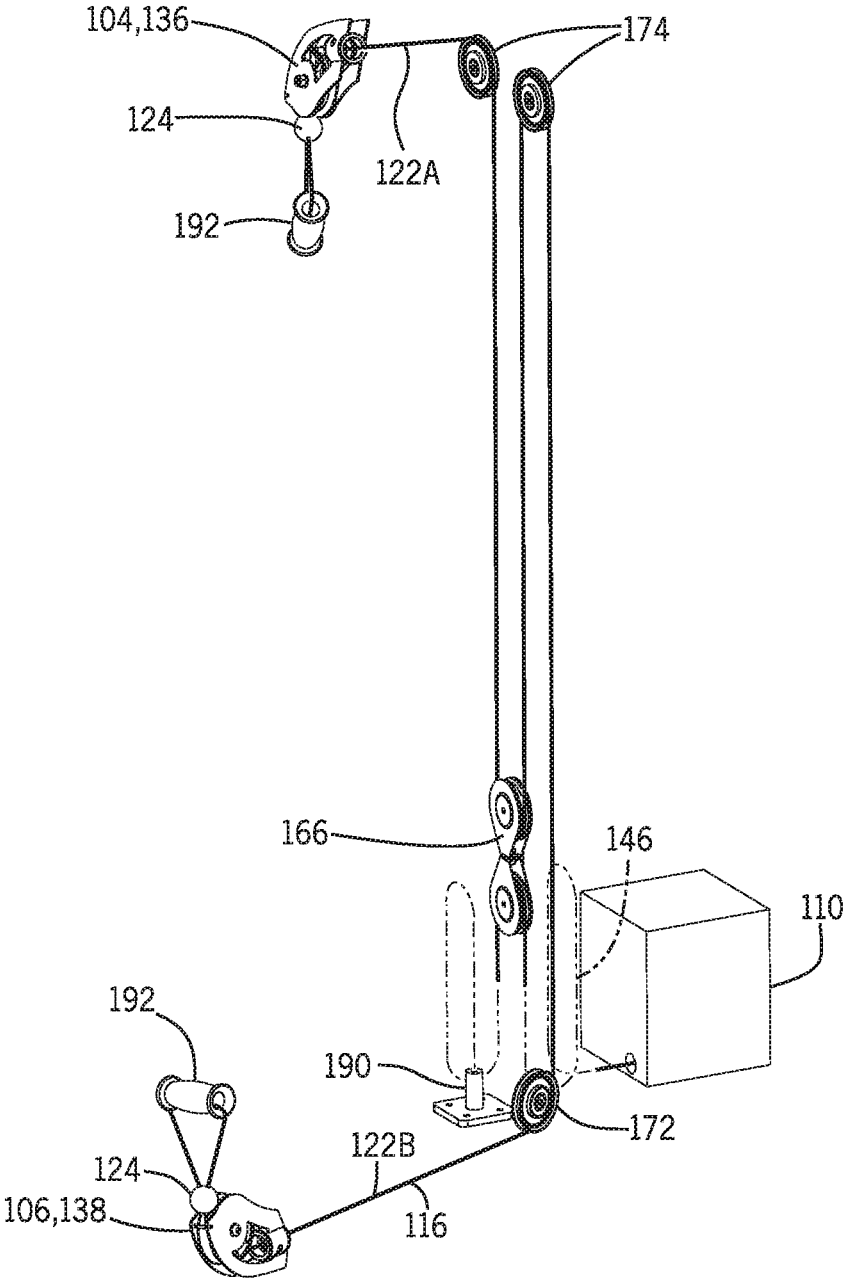
FIG. 5 is an isometric view of the routing of the cable member highlighted in FIG. 4 with other features removed for clarity.
Figure 6:
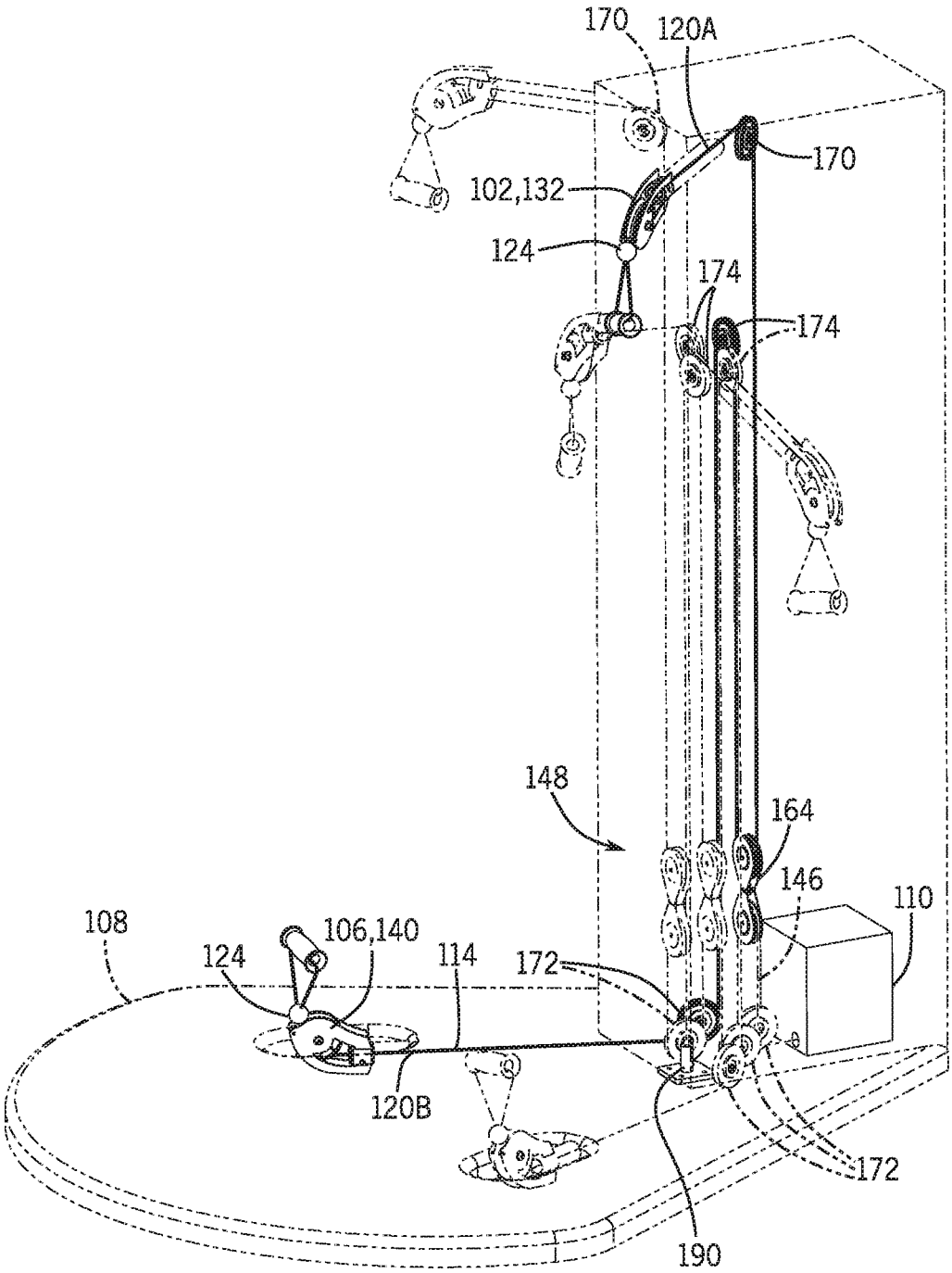
FIG. 6 is another isometric view of the exercise machine of FIG. 1.
Figure 7:
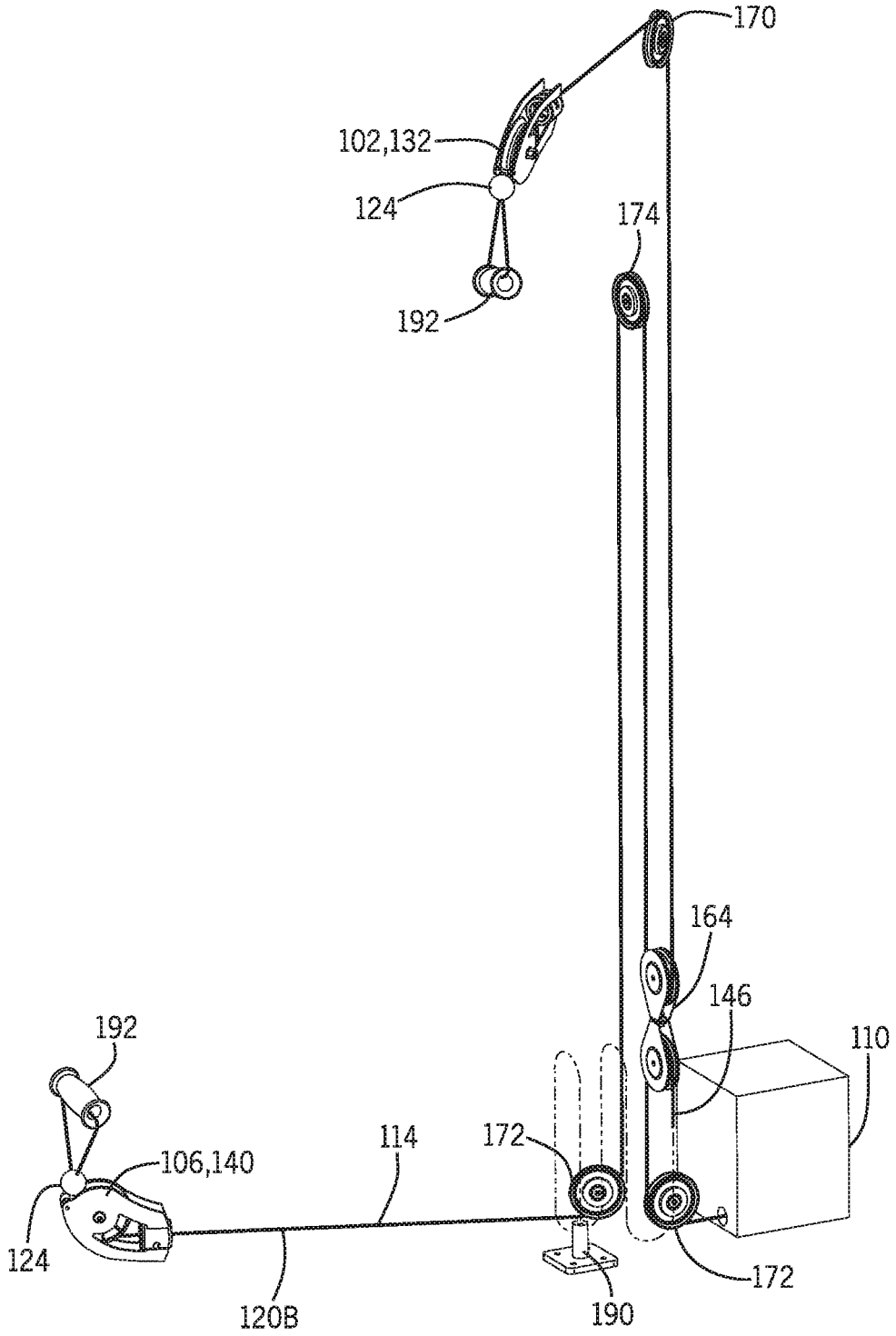
FIG. 7 is an isometric view of the routing of the cable member highlighted in FIG. 6 with other features removed for clarity.

Referring to FIG. 1, an embodiment of an exercise machine 100 may include at least a first plurality and a second plurality of corresponding engagement points 102, 104. In some embodiments, the exercise machine 100 may include a third plurality of corresponding engagement points 106. Each of the corresponding engagement points 102, 104, 106 may be operably connected to a frame 108 and operatively associated with a resistance element 110, such as a DC motor, a single weight or mass, a weight stack, an eddy-current magnetic brake, a fan, a resilient elastomeric element(s), or a combination thereof. With reference to FIGS. 2-7, the exercise machine 100 may include a plurality of elongated flexible members (e.g., a first elongated flexible member such as first cable 112, a second elongated flexible member such as second cable 114, and a third elongated flexible member such as third cable 116) each extending between two engagement points 102, 104, 106 and operable to actuate the resistance element 110. As illustrated in FIGS. 2-7, an engine cable 146, which may also be referred to as an elongated flexible member, may be connected to the resistance element 110 and operably associated with each of the first cable 112, the second cable 114, and the third cable 116 through a pulley system 148, as described in detail below, Though described below with reference to cables, each of the elongated flexible members (e.g., the first cable 112, the second cable 114, the third cable 116, and the engine cable 146) may be a rope, a wire, or a strap, chain, or other elongated member able to bend along its length around a pulley and support a typical exercise load.

As described herein, the term "corresponding," when used with "engagement points," refers to engagement points that are associated with the same, or substantially the same, position, elevation, or height on the exercise machine 100. For instance, in some embodiments, the first plurality of corresponding engagement points 102 may be associated with performing a first exercise with a first set of high pulley body exercises, the second plurality of corresponding engagement points 104 may be associated with performing a second exercise within a second set of intermediate height or mid pulley body exercises, and the third plurality of corresponding engagement points 106 may be associated with performing a third exercise within a third set of low pulley body exercises. In this example, the first plurality of corresponding engagement points 102 may be positioned above the second plurality of corresponding engagement points 104, and the second plurality of corresponding engagement points 104 may be positioned above the third plurality of corresponding engagement points 106. In one example, each of the corresponding engagement points 102, 104, 106, which may be referred to as anchor points, attachment points, load engagement features, or load engagement points, may be a pulley or other structure for use with cables to perform a selected exercise.

For example without limitation, the first plurality of corresponding engagement points 102 may be associated with performing exercises wherein a vector of an actuation force F is directed generally downwardly, such as pull-downs, pushdowns, and high pulley rows, among others. The second plurality of corresponding engagement points 104 may be associated with performing exercises wherein a vector of an actuation force F is directed generally laterally, downwardly, and/or upwardly, such as standing presses, seated rows, and fly exercises, among others. The third plurality of corresponding engagement points 106 may be associated with performing exercises wherein a vector of an actuation force F is directed generally upwardly, such as without limitation upright rows, squats, curls, extensions, and presses. The first, second, and third pluralities of corresponding engagement points 102, 104, 106 may define the tail position of an actuation force F vector applied at each of the corresponding engagement points 102, 104, 106.

With reference to FIGS. 2-7, one of the first plurality of corresponding engagement points 102 may be associated with a first cable portion 118A of the first cable 112, and another of the first plurality of corresponding engagement points 102 may be associated with a first cable portion 120A of the second cable 114. One of the second plurality of corresponding engagement points 104 may be associated with a second cable portion 118B of the first cable 112, and another of the second plurality of corresponding engagement points 104 may be associated with a first cable portion 122A of the third cable 116. One of the third plurality of corresponding engagement points 106 may be associated with a second cable portion 120B of the second cable 114, and another of the third plurality of corresponding engagement points 106 may be associated with a second cable portion 122B of the third cable 116. In the embodiments described herein, the first cable portion 118A, 120A, 122A of each cable 112, 114, 116 is distal from its respective second cable portion 118B, 120B, 122B. In this manner, the opposing cable portions 118A, 118B of the first cable 112 may be associated with and extend between one of the first plurality of corresponding engagement points 102 and another engagement point not in the first plurality of corresponding engagement points 102 (e.g., one of the second plurality of corresponding engagement points 104) (see FIG. 2). Similarly, the opposing cable portions 120A, 120B of the second cable 114 may be associated with and extend between another of the first plurality of corresponding engagement points 102 and another engagement point not in the first plurality of corresponding engagement points 102 (e.g., one of the third plurality of corresponding engagement points 106) (see FIG. 4). In such embodiments, the opposing cable portions 122A, 122B of the third cable 116 may be associated with and extend between one of the third plurality of corresponding engagement points 106 and another engagement point not in the third plurality of corresponding engagement points 106 (e.g., another of the second plurality of corresponding engagement points 104) (see FIG. 6).

As best seen in FIGS. 2-7, the cable portions 118A, 118B, 120A, 120B, 122A, 122B of each cable 112, 114, 116 do not extend to engagement points within the same plurality of corresponding engagement points. In this manner, actuation forces F applied to the cable portions 118A, 120A of the first and second cables 112, 114 associated with the first plurality of corresponding engagement points 102 may cause the first and second cables 112, 114 to extend from their respective first plurality of corresponding engagement points 102 (see FIG. 13) and actuate the resistance element 110. In like manner, actuation forces F applied to the cable portions 118B, 122A of the first and third cables 112, 116 associated with the second plurality of corresponding engagement points 104 may cause the first and third cables 112, 116 to extend from their respective second plurality of corresponding engagement points 104 and actuate the resistance element 110. Similarly, actuation forces F applied to the cable portions 120B, 122B of the second and third cables 114, 116 associated with the third plurality of corresponding engagement points 106 may cause the second and third cables 114, 116 to extend from their respective third plurality of corresponding engagement points 106 and actuate the resistance element 110. The cable portions 118A, 118B, 120A, 120B, 122A, 122B, which may be referred to as end portions, terminal ends, or adjacent terminal ends, among others, of each of the first, second, and third cables 112, 114, 116 may include an enlarged end portion 124, which is retracted to or adjacent its associated engagement point when not extended to define a retracted position of each respective cable portion by limiting the cable portion from retracting too far, as detailed below. In some embodiments, the enlarged end portion 124 may be formed as an ellipsoid or sphere having a diameter greater than the diameter of a corresponding cable.

Figure 11:
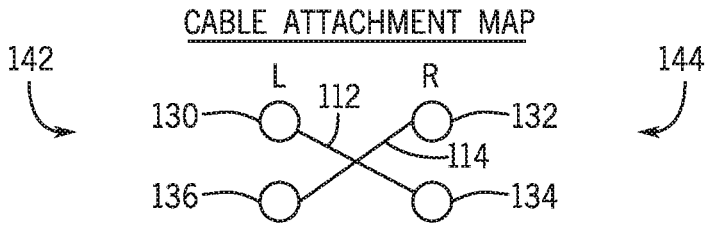
FIG. 11 is a schematic representation of a cable attachment map of the exercise machine of FIG. 1.
Figure 12:
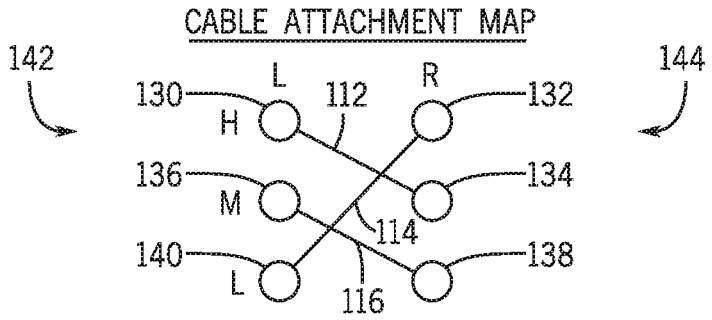
FIG. 12 is a schematic representation of another cable attachment map of the exercise machine of FIG. 1.

Referring to FIG. 1, in one exemplary embodiment, the first plurality of corresponding engagement points 102 may include a first pair of corresponding engagement points (i.e., first and second high engagement points 130, 132), the second plurality of corresponding engagement points 104 may include a second pair of corresponding engagement points (i.e., first and second mid-engagement points 134, 136), and the third plurality of corresponding engagement points 106 may include a third pair of corresponding engagement points (i.e., first and second low engagement points 138, 140). As schematically shown in FIG. 11, in an embodiment with only two cables (e.g., the first and second cables 112, 114), the first cable 112 may extend between the first high engagement point 130 and the first mid engagement point 134, and the second cable 114 may extend between the second high engagement point 132 and the second mid engagement point 136. As schematically shown in FIG. 12, in an embodiment with three cables (e.g., the first, second, and third cables 112, 114, 116), the first cable 112 may extend between the first high engagement point 130 and the first mid engagement point 134, the third cable 116 may extend between the second mid engagement point 136 to the first low engagement point 138, and the second cable 114 may extend between the second low engagement point 140 to the second high engagement point 132. The examples above are non-limiting and other combinations are contemplated for both the two cable and three cable systems, for example such that for the three cable system the opposing cable portions 118A, 118B, 120A, 120B, 122A, 122B of each respective cable 112, 114, 116 are not positioned within, or associated with, the same plurality of corresponding engagement points 102, 104, 106.

In some embodiments, each of the first, second, and third cables 112, 114, 116 may extend from a first side 142 (i.e., a left side of the exercise machine 100 shown in FIG. 1) to a second side 144 (i.e., a right side of the exercise machine 100 shown in FIG. 1) of the exercise machine 100 opposite the first side 142. In one embodiment, the first high engagement point 130, the second mid engagement point 136, and the second low engagement point 140 may be positioned on the first side 142 of the exercise machine 100, and the first mid engagement point 134, the first low engagement point 138, and the second high engagement point 132 may be positioned on the second side 144 of the exercise machine 100. Alternatively, each of the high, mid, and low engagement points 130, 132, 134, 136, 138, 140 may be positioned on one side of the exercise machine 100.

Turning now to FIGS. 2-7, in one embodiment, the engine cable 146 may include opposing first and second end portions 150, 152. In such embodiments, the first end portion 150, which may be referred to as a fixed end, may be affixed or anchored to a structure (e.g., the frame 108). The second end portion 152, which may be referred to as a movable end, may be movable and may be connected to the resistance element 110. In such embodiments, movement of at least one of the first, second, and/or third cables 112, 114, 116 may move the second end portion 152 of the engine cable 146 to actuate the resistance element 110 and actuate the load, such as by rotating a shaft associated with a DC motor, lifting a selected number of weight plates (see broken line portion in FIG. 10), rotating a magnetic material positioned on a shaft through a variable magnetic field, rotating a fan-like member that resists movement of air or fluid there through, extending an elastomeric member or group of members, or any other suitable mechanism or combination thereof. The resistance element 110 resists movement of the engine cable 146, and, in some embodiments, may be operable to resist movement of at least one of the plurality of cables 112, 114, 116. In some embodiments, the first end portion 150 of the engine cable 146 may be repositionable or selectively secured to remove any buildup of slack, if any, in the engine cable 146, for instance, as explained in more detail below.

In one embodiment, the resistance element 110 may be operable to provide a desired exercise resistance to a user. For example, the resistance element 110 may be a DC motor, a weight stack, a rotary damper, a resilient elastomeric mechanism (such as bungee cords, torsional wheels or disks, or resistance rods), a disc and brake pad assembly, an electro-magnetic device, or any other suitable mechanism operable to generate a resistive load. In some examples, the resistance element 110 may include selectable load levels to provide a selectable variable resistance depending on a desired characteristic for a given exercise. For instance, the amount of resistance provided by the resistance element 110 may be selectable by a user (i.e., selecting different weights in a weight stack, increasing or decreasing the amount of damping provided by a rotary damper, increasing or decreasing the amount of braking provided by an eddy current magnetic brake mechanism, selecting a less resilient or more resilient elastomeric element, etc.) and may or may not vary depending on the position of the cable portions 118A, 118B, 120A, 120B, 122A, 122B relative to the associated corresponding engagement points 102, 104, 106 (i.e., the load may increase, linearly or otherwise, as the cable portions 118A, 118B, 120A, 120B, 122A, 122B extend away from the associated corresponding engagement points 102, 104, 106).

With continued reference to FIGS. 2-7, the pulley system 148 may operably connect each of the cables 112, 114, 116 to the resistance element 110 to provide a desired resistance to a user for a selected exercise. The pulley system 148 may route the engine cable 146 and the first, second, and third cables 112, 114, 116 such that the cables 112, 114, 116 actuate the resistance element 110 regardless of the relative position of the corresponding engagement points 102, 104, 106. For example, in some embodiments, the resistance element 110 may be positioned at least partially above one of the pluralities of corresponding engagement points 102, 104, 106 (i.e., above the third plurality of corresponding engagement points 106). In such embodiments, the pulley system 148 is operable to route the cables 112, 114, 116 (e.g., the second cable 114 and the third cable 116) associated with the third plurality of corresponding engagement points 106 so the second cable 114 and/or the third cable 116 may actuate the resistance element 110. The pulley system 148 operably associated with the first and second pluralities of corresponding engagement points 102, 104 may be similarly configured.

Figure 8:
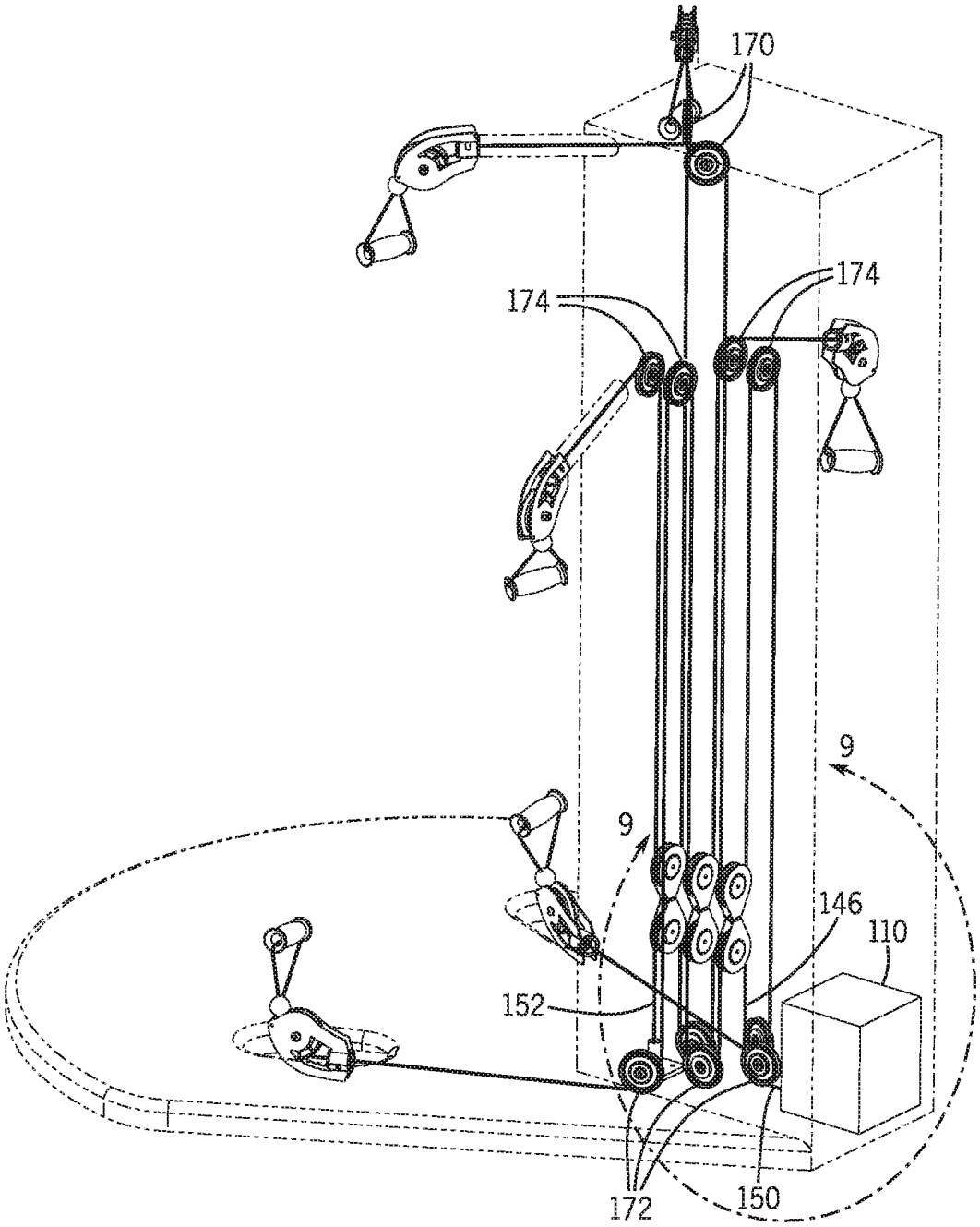
FIG. 8 is a top, rear isometric of the exercise machine of FIG. 1.
Figure 9:
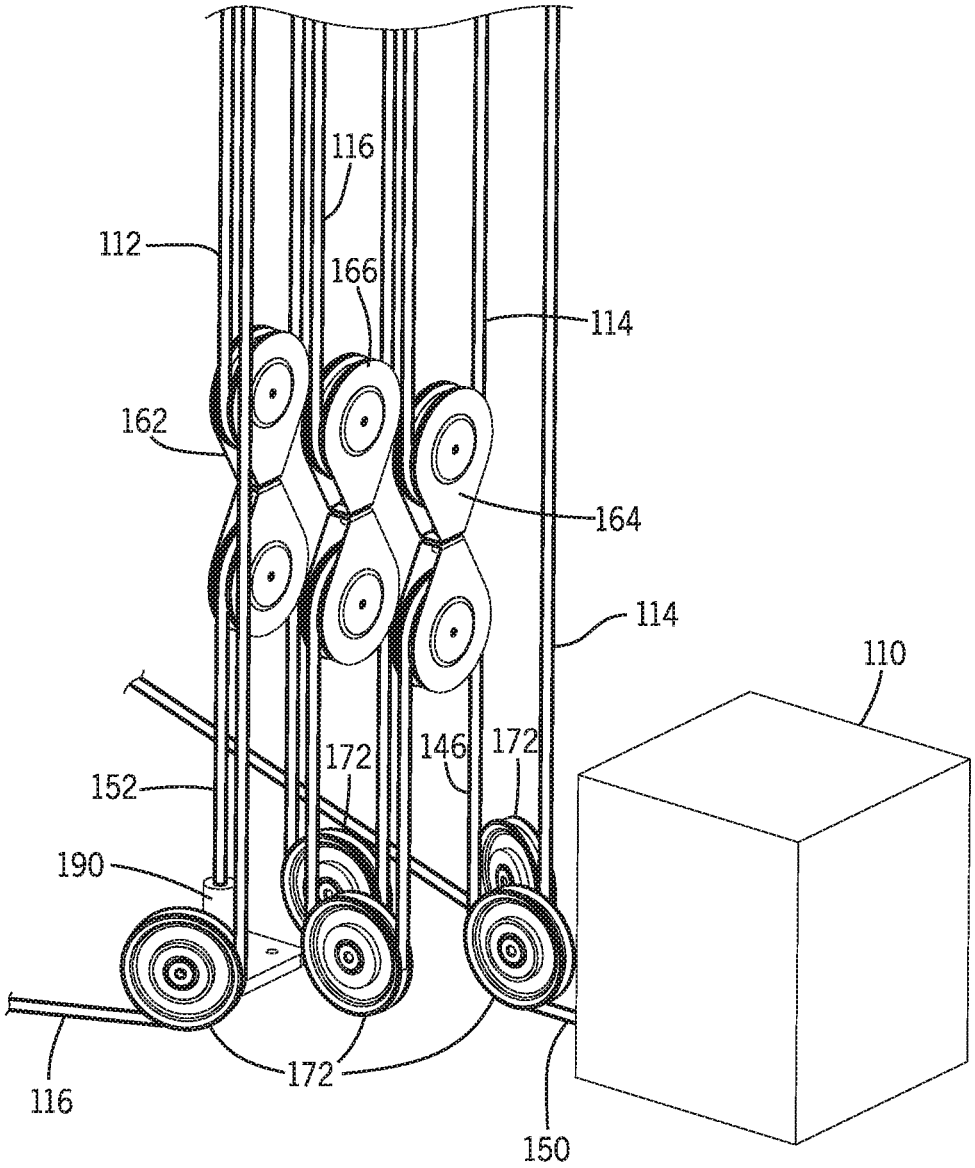
FIG. 9 is an enlarged, fragmentary view of a portion of a pulley system of the exercise machine of FIG. 1.
Figure 10:
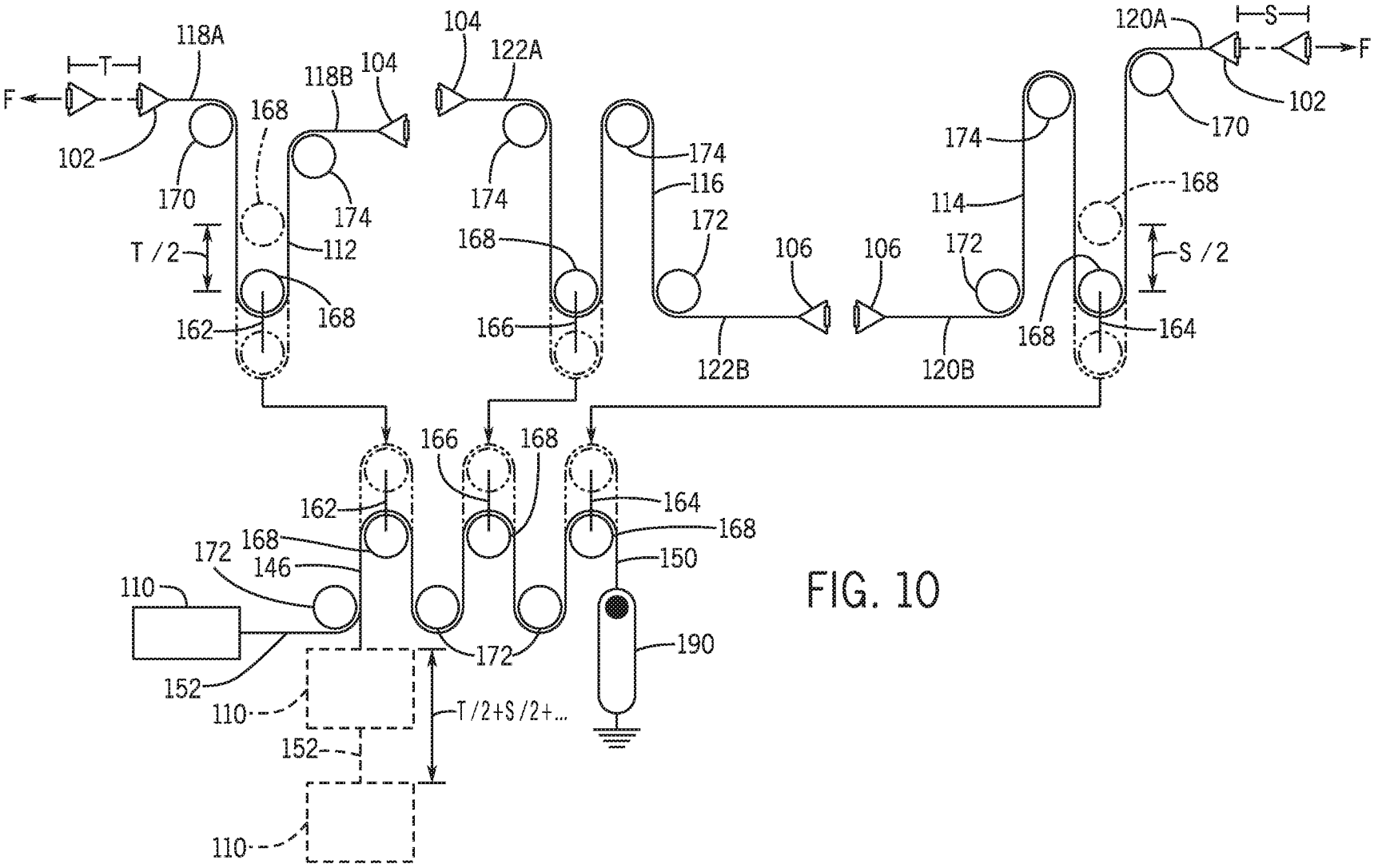
FIG. 10 is a schematic representation of the pulley system of the exercise machines of FIG. 1.

With reference to FIGS. 2-10, the pulley system 148 may include at least a first pulley structure 162, a second pulley structure 164, and a third pulley structure 166 connecting the first cable 112, the second cable 114, and the third cable 116, respectively, to the engine cable 146. The first, second, and third pulley structures 162, 164, 166, which may be referred to as lifting pulleys, may not be attached to any surrounding structure such that the pulley structures are considered "floating." As shown in FIG. 10, each of the first pulley structure 162, the second pulley structure 164, and the third pulley structure 166 may include a pair of pulley wheels 168 positioned at opposing ends of the respective pulley structure. One of the opposing pulley wheels 168 may be wrapped by the engine cable 146, and the other pulley wheel 168 may be wrapped by one of the first cable 112, the second cable 114, and the third cable 116. In such embodiments, activation of the first cable 112 moves (e.g., lifts) the first pulley structure 162 thereby moving the engine cable 146 and causing the second end portion 152 of the engine cable 146 to actuate the resistance element 110. Activation of the second and third cables 114, 116 respectively moves (e.g., lifts) the second and third pulley structures 164, 166 in a similar manner.

Figure 13:
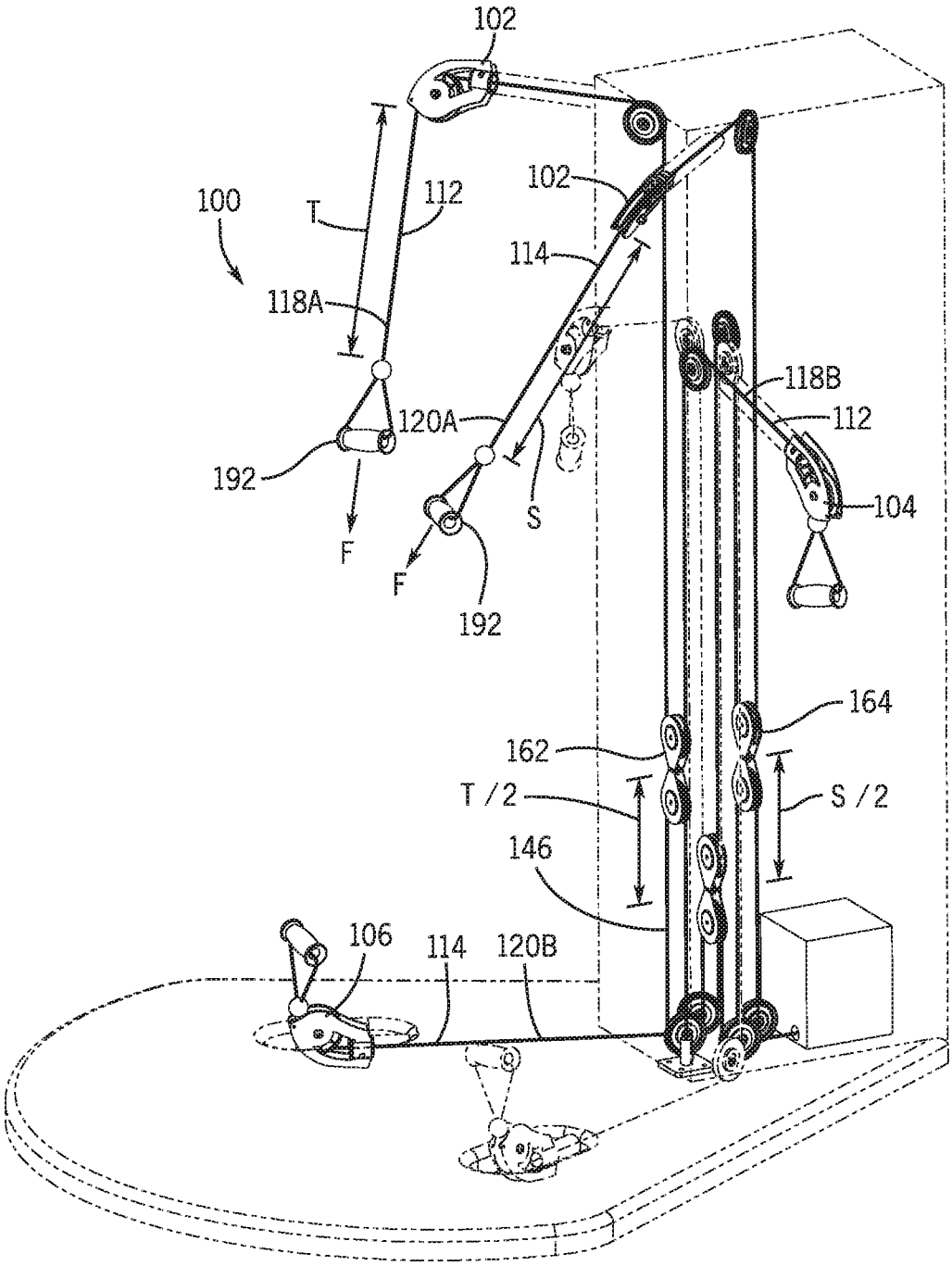
FIG. 13 is an isometric view of the exercise machine showing extension of two cables from a rest position.

For example, as shown in in FIGS. 10 and 13, an actuation force F may cause the first cable portion 118A of the first cable 112 to extend an extension distance T from an associated engagement point of the first plurality of corresponding engagement points 102. In such embodiments, the configuration of the pulley system 148 may move (e.g., lift) the first pulley structure 162 half the extension distance T (i.e., a distance T/2), and thereby move the second end portion 152 of the engine cable 146 and, in some embodiments, the resistance element 110 the same distance T/2. Similarly, movement of the second cable 114 and the third cable 116, either individually or collectively with another cable, by an actuation force F may cause similar effects on the engine cable 146 and the resistance element 110 through the second and third pulley structures 164, 166. For instance, an actuation force F may cause the first cable portion 120A of the second cable 114 to extend an extension distance S from an associated engagement point of the first plurality of corresponding engagement points 102. The pulley system 148 may move (e.g., lift) the second pulley structure 164 half the extension distance S (i.e., a distance S/2) such that the second end portion 152 of the engine cable 146 and, in some embodiments, the resistance element 110 move the same distance S/2. Similar results may be achieved by an actuation force F acting on one of the opposing cable portions 122A, 122B of the third cable 116.

In some embodiments, the effects of each of the first cable 112, the second cable 114, and the third cable 116 on the resistance element 110 and the second end portion 152 of the engine cable 146 may be cumulative. For instance, the second end portion 152 of the engine cable 146 may move a distance equal to the sum of distances traveled by the first pulley structure 162, the second pulley structure 164, and the third pulley structure 166. In this manner, during an exercise movement wherein both cable portions in corresponding engagement points are moved, the pulley system 148 may cause the second end portion 152 of the engine cable 146 to move a distance equal to the sum of distances traveled by the pulley structures associated with the corresponding engagement points. For example, during a given exercise wherein the first cable portion 118A of the first cable 112 and the first cable portion 120A of the second cable 114 are extended, respectively, extension distances T and S from associated engagement points of the first plurality of corresponding engagement points 102 (see FIG. 13), the resistance element 110 and/or the second end portion 152 of the engine cable 146 may move a distance equal to T/2 plus S/2. In such embodiments, the engine cable 146 may include a length sufficient to permit full actuation of the resistance element 110 during full extensions of at least two of the first cable 112, the second cable 114, and the third cable 116 during a given exercise.

Referring to FIGS. 2-10, in addition to the first, second, and third pulley structures 162, 164, 166, the pulley system 148 may include a plurality of fixed pulley wheels such that each of the engine cable 146 and the first, second, and third cables 112, 114, 116 are routed around at least three pulley wheels of the pulley system 148. For instance, the pulley system 148 may include two upper pulley wheels 170, five lower pulley wheels 172, and four intermediate pulley wheels 174 positioned between the upper pulley wheels 170 and the lower pulley wheels 172. In such embodiments, the two upper pulley wheels 170 may be positioned generally adjacent the first plurality of corresponding engagement points 102, the four intermediate pulley wheels 174 may be positioned generally adjacent the second plurality of corresponding engagement points 104, and the five lower pulley wheels 172 may be positioned generally adjacent the third plurality of corresponding engagement points 106. The intermediate pulley wheels 174 may be positioned relative to the lower pulley wheels 172 and/or the first, second, and third pulley structures 162, 164, 166 to allow full extension of the first, second, and/or third cables 112, 114, 116 and the associated movement of the first, second, and third pulley structures 162, 164, 166. As detailed below, each of the upper pulley wheels 170, the intermediate pulley wheels 174, and the lower pulley wheels 172 may be affixed to the frame 108.

Turning to FIGS. 2-10, the pulley system 148 may be configured to route each of the first cable 112, the second cable 114, the third cable 116, and the engine cable 146 within the exercise machine 100 to, for example, minimize the size and/or complexity of the exercise machine 100. For instance, the first cable 112 may be routed from one of the first plurality of corresponding engagement points 102, around one of the upper pulley wheels 170, around one of the opposing pulley wheels 168 of the first pulley structure 162, around one of the intermediate pulley wheels 174, and to one of the second plurality of corresponding engagement points 104 (see FIGS. 2 and 10). The third cable 116 may be routed from one of the third plurality of corresponding engagement points 106, around one of the lower pulley wheels 172, around one of the intermediate pulley wheels 174, around one of the opposing pulley wheels 168 of the third pulley structure 166, around another of the intermediate pulley wheels 174, and to one of the second plurality of corresponding engagement points 104 (see FIGS. 4 and 10). The second cable 114 may be routed from one of the third plurality of corresponding engagement points 106, around one of the lower pulley wheels 172, around one of the intermediate pulley wheels 174, around one of the opposing pulley wheels 168 of the second pulley structure 164, around one of the upper pulley wheels 170, and to one of the first plurality of corresponding engagement points 102 (see FIGS. 6 and 10).

Continuing, the engine cable 146 may be routed from its first end portion 150, around one of the opposing pulley wheels 168 of the second pulley structure 164, around one of the lower pulley wheels 172, around one of the opposing pulley wheels 168 of the third pulley structure 166, around another of the lower pulley wheels 172, around one of the opposing pulley wheels 168 of the first pulley structure 162, and to the resistance element 110 (see FIGS. 8-10). In some embodiments, the engine cable 146 may be routed around another lower pulley wheel 172 positioned between the first pulley structure 162 and the resistance element 110 depending on space constraints and the specific operation of the resistance element 110 (see FIG. 10). In this manner, the first cable 112 may be routed around at least three pulley wheels, the second and third cables 114, 116 may be routed around at least four pulley wheels, and the engine cable 146 may be routed around at least five pulley wheels and preferably six pulley wheels. In some embodiments, the number of pulley wheels connected to the engine cable 146 may be twice the number of cables within the exercise machine 100 (i.e., four pulley wheels for two cables, six pulley wheels for three cables, etc.). Each of the first, second, and third pulley structures 162, 164, 166 may be positioned between the five lower pulley wheels 172 and the four intermediate pulley wheels 174.

With reference to FIG. 1, the first cable 112, the second cable 114, the third cable 116, the engine cable 146, the resistance element 110, the pulley system 148, and each plurality of corresponding engagement points 102, 104, 106 may be operably associated with the frame 108 of the exercise machine 100. In one embodiment, the frame 108 may include a platform 178 and a framework forming a column 180 extending substantially vertically from the platform 178. In some embodiments, the platform 178 may be placed on a support surface such as a floor in an exercise space. The platform 178 may be substantially planar and may include one or more of the first, second, and third pluralities of corresponding engagement points 102, 104, 106 (e.g., the third plurality of corresponding engagement points 106). The column 180, which may be an open framework of support members, may include one, two, or more of the first, second, and third pluralities of corresponding engagement points 102, 104, 106 (e.g., the first and second pluralities of corresponding engagement points 102, 104). In this manner, the opposing cable portions 118A, 118B, 120A, 120B, 122A, 122B of each of the first, second, and third cables 112, 114, 116 may be positioned at different positions, levels, elevations, heights, and/or locations of the frame 108 (e.g., high, mid, low) such that opposing cable portions of the same cable are not used when corresponding engagement points are used for a selected exercise, or the like.

In one embodiment, the frame 108 may provide a structure to which portions of the exercise machine 100 are anchored or affixed. For example, each of the fixed pulley wheels may be affixed to a portion (e.g., an inner wall or surface) of the column 180 by brackets, fasteners, or other suitable mechanisms. In like manner, the first end portion 150 of the engine cable 146 may be connected to a fixed portion of the frame 108, such as the platform 178 and/or the column 180 (see FIG. 8). In some embodiments, the first end portion 150 of the engine cable 146 may be connected to a slack adjustment mechanism 190 affixed to the frame 108 (e.g., to the platform 178) and operable to maintain tension within the pulley system 148 by selectively moving or adjusting the slack adjustment mechanism 190 to remove any build-up of slack, if any, in the engine cable 146, for instance (see FIG. 10). For example, the slack adjustment mechanism 190 may be operable to reposition the first end portion 150 of the engine cable 146 to achieve a desired tension within the engine cable 146.

With continued reference to FIG. 1, the exercise machine 100 may include other features to provide a desired aesthetic and/or functional characteristic. For example, in some embodiments, the platform 178 may include a non-slip top surface 182 to prevent slipping of a user's hands and/or feet while performing a given exercise. In some embodiments, the column 180 may be open and/or may include housing panels or portions. In such embodiments, the resistance element 110, the engine cable 146, the pulley system 148, and/or a majority of each of the first, second, and third cables 112, 114, 116 may be positioned within the column 180 and at least partially hidden from view within the framework and/or behind a housing panel (see FIG. 1).

The exercise machine 100 may include an exercise attachment 192 connected to the opposing cable portions 118A, 118B, 120A, 120B, 122A, 122B of each of the first, second, and third cables 112, 114, 116. The exercise attachment 192 may be a bar, a rope, a handle, a strap or cuff, or any other attachment or actuator used to perform cable exercises and may be attached to the opposing cable portions 118A, 118B, 120A, 120B, 122A, 122B by a carabiner, fastener, or any other suitable attachment mechanism. Though an exercise attachment 192 is shown attached to each opposing cable portion 118A, 118B, 120A, 120B, 122A, 122B of the first, second, and third cables 112, 114, 116, the exercise attachment 192 may be connected to only one of the opposing cable portions 118A, 118B, 120A, 120B, 122A, 122B of a respective cable 112, 114, 116. Similarly, a single exercise attachment 192 can be connected to one of the opposing cable portions 118A, 118B, 120A, 120B, 122A, 122B of two cables 112, 114, 116 (i.e., to the first and second cables 112, 114, to the first and third cables 112, 116, or to the second and third cables 114, 116) to provide increased resistance and/or to accommodate for barbell-type exercises.

According to one embodiment of the present disclosure, an elongated arm 194 defining opposing first and second ends 196, 198 may be positioned adjacent at least two of the first, second, and third pluralities of corresponding engagement points 102, 104, 106. The first end 196 may be coupled to the frame 108 (e.g., to the column 180) with the second end 198 spaced away from the column 180 by the length of the arm 194. In some embodiments, the first end 196 may be rotatably coupled to the column 180 such that the arm 194 may selectively articulate relative to the frame 108 to a desired position. For example, each arm 194 may articulate vertically up and down (i.e., away from and towards the platform 178), and in some embodiments may articulate horizontally forward and aft (i.e., towards and away from a user). In some embodiments, the second end 198 of each arm 194 may be fixed vertically and/or horizontally depending on a desired characteristic of the exercise machine 100. Once in a desired position, each arm 194 may be selectively locked into position by a user through, for example, a locking pin or a corresponding retention structure at the first end 196 of the arm 194. In some embodiments, the second end 198 may include a guide member 200 including a guide pulley 202. The guide member 200 may freely rotate about a longitudinal axis of the arm 194 such that the guide pulley 202 is substantially in line with the respective cable when a user applies an actuation force F to a cable portion positioned at the second end 198 of the arm 194. Though the third plurality of corresponding engagement points 106 is not shown to include an elongate arm 194, the third plurality of corresponding engagement points 106 may include a similar guide member 200 and guide pulley 202. As shown in FIG. 1, each guide member 200 of the third plurality of corresponding engagement points 106 may be received at least partially in a cavity 204 defined in the top surface 182 of the platform 178. Each guide member 200 may be free to rotate within the respective cavity 204 for at least the same purposes as explained above.

To maintain tension within the pulley system 148, the guide member 200 may include a limit structure 206 to engage the enlarged end portions 124 of the first, second, and third cables 112, 114, 116 and limit movement of each cable portion into the exercise machine 100. In one embodiment, the limit structure 206 and the guide pulley 202 may define a gap 208. The gap 208 is shaped and sized to permit movement of at least a portion of the first, second, and third cables 112, 114, 116 there through but restricts or stops the enlarged end portion 124 on the end of each cable 112, 114, 116, and operates to define the retracted position of each respective cable portion 118A, 118B, 120A, 120B, 122A, 122B. For example, the enlarged end portion 124 of each cable 112, 114, 116 may include a dimension greater than the dimension of the gap 208 such that contact between the enlarged end portion 124 and the limit structure 206 defines the retracted position of each respective cable portion 118A, 118B, 120A, 120B, 122A, 122B.

The exercise machine 100 may be formed from a variety of materials and means. For instance, the frame 108, the corresponding engagement points 102, 104, 106, and the pulleys 162, 164, 166, 170, 172, 174, among others, may be formed from metal, plastic, or other suitable material with sufficient strength. Metals may include aluminum, steel, titanium, or any other suitable metal, alloy, or composite. Plastics may include a thermoplastic material (self-reinforced or fiber reinforced), nylon, LDPE, ABS, polycarbonate, polypropylene, polystyrene, PVC, polyamide, and/or PTFE, among others, and may be formed or molded in any suitable manner, such as by plug molding, blow molding, injection molding, extrusion, or the like. Similarly, the first cable 112, the second cable 114, the third cable 116, and the engine cable 146 may be a flexible nylon or steel wire, braided or otherwise, and may be coated with a vinyl or other coating for increased durability.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. An exercise machine comprising:

a frame;

a resistance element;

a first plurality of engagement points operatively associated with the frame and comprising left and right engagement points at a first elevation;

a second plurality of engagement points operatively associated with the frame and comprising left and right engagement points at a second elevation different than the first elevation;

a third plurality of engagement points operatively associated with the frame, wherein the third plurality of engagement points are at a third elevation different than the first and second elevations; and first, second and third elongated flexible members routed through a pulley system operatively associated with the frame and wherein:

the first elongated flexible member is operably associated with the resistance element and includes a first end portion associated with the left engagement point of the first plurality of engagement points and a second end portion associated with the right engagement point of the second plurality of engagement points, and the first elongated flexible member extends between the left engagement point of the first plurality of engagement points and the right engagement point of the second plurality of engagement points;

the second elongated flexible member is operably associated with the resistance element and includes a first end portion associated with the right engagement point of the first plurality of engagement points and a second end portion associated with a left engagement point not in the first plurality of engagement points, and the second elongated flexible member extends between the right engagement point of the first plurality of engagement points and the left engagement point not in the first plurality of engagement points;

the first end portion of the first elongated flexible member is joined to a first exercise attachment, and the second end portion of the first flexible member is joined to a second exercise attachment;

application of an actuation force to either of the first exercise attachment or the second exercise attachment extends the respective one of the first end portion of the first elongated flexible member or the second end portion of the first flexible member away from the associated left engagement point or right engagement point of the first and second plurality of engagement points and actuates the resistance element;

the first, second and third elongated flexible members are operably associated with the resistance element via an engine cable; and the third elongated flexible member includes opposing end portions associated with and extending between one of the third plurality of engagement points and another engagement point not in the third plurality of engagement points.

2. The exercise machine of claim 1, wherein the second elongated flexible member extends between the right engagement point of the first plurality of engagement points and the left engagement point of the second plurality of engagement points.

3. The exercise machine of claim 1, wherein each of the first and second pluralities of corresponding engagement points is associated with a different exercise function.

4. The exercise machine of claim 3, wherein each of the first and second pluralities of corresponding engagement points is associated with performing a selected exercise.

5. The exercise machine of claim 1, wherein the pulley system includes at least a first pulley structure and a second pulley structure connecting the first elongated flexible member and the second elongated flexible member, respectively, to the engine cable.

6. The exercise machine of claim 1, wherein the pulley system comprises at least three first pulley wheels and wherein the first elongated flexible member is routed around the at least three first pulley wheels.

7. The exercise machine of claim 6, wherein the pulley system comprises at least four second pulley wheels and wherein the second elongated flexible member is routed around the at least four second pulley wheels.

8. The exercise machine of claim 1, wherein the third elongated flexible member extends between one of the third plurality of engagement points and one of the second plurality of engagement points.

9. The exercise machine of claim 1, wherein the pulley system comprises at least four pulley wheels and wherein the third elongated flexible member is routed around at least four pulley wheels of the pulley system.

10. The exercise machine of claim 1, wherein the frame includes a platform and a framework forming a column extending vertically from the platform.

11. The exercise machine of claim 10, wherein:

the column includes at least one of the first, second, and third pluralities of engagement points; and the platform includes at least another one of the first, second, and third pluralities of engagement points.

12. The exercise machine of claim 10, wherein the resistance element, the engine cable, and a majority of each of the first and second elongated flexible members are positioned within the column.

13. The exercise machine of claim 1, wherein the engine cable includes opposing first and second end portions, the first end portion being fixed, and the second end portion connected to the resistance element; wherein movement of at least one of the first and second elongated flexible members causes the second end portion of the engine cable to actuate the resistance element.

14. The exercise machine of claim 13, wherein the engine cable is routed through the pulley system.

15. The exercise machine of claim 13, wherein:

the pulley system includes a plurality of lifting pulleys associated with the first and second elongated flexible members; and the engine cable is operably associated with the first and second elongated flexible members through the plurality of lifting pulleys.

16. The exercise machine of claim 13, wherein:

the actuation force causes at least one end portion of the first and second elongated flexible members to extend from an associated engagement point an extension distance; and the second end portion of the engine cable moves half the extension distance.

17. The exercise machine of claim 13, wherein the first end portion of the engine cable is repositionable to remove slack in the engine cable.

18. An exercise machine comprising:

a frame;

a resistance element;

a first plurality of engagement points operatively associated with the frame and comprising left and right engagement points at a first elevation;

a second plurality of engagement points operatively associated with the frame and comprising left and right engagement points at a second elevation different than the first elevation;

first and second elongated flexible members routed through a pulley system operatively associated with the frame;

an engine cable routed through the pulley system and operably associated with the first and second elongated flexible members, the engine cable including opposing first and second end portions, the first end portion being fixed, and the second end portion connected to the resistance element; and wherein:

the first elongated flexible member is operably associated with the resistance element and includes a first end portion associated with the left engagement point of the first plurality of engagement points and a second end portion associated with the right engagement point of the second plurality of engagement points, and the first elongated flexible member extends between the left engagement point of the first plurality of engagement points and the right engagement point of the second plurality of engagement points;

the second elongated flexible member is operably associated with the resistance element and includes a first end portion associated with the right engagement point of the first plurality of engagement points and a second end portion associated with a left engagement point not in the first plurality of engagement points, and the second elongated flexible member extends between the right engagement point of the first plurality of engagement points and the left engagement point not in the first plurality of engagement points;

the first end portion of the first elongated flexible member is joined to a first exercise attachment, and the second end portion of the first flexible member is joined to a second exercise attachment;

application of an actuation force to either of the first exercise attachment or the second exercise attachment extends the respective one of the first end portion of the first elongated flexible member or the second end portion of the first flexible member away from the associated left engagement point or right engagement point of the first and second plurality of engagement points and actuates the resistance element; and movement of at least one of the first and second elongated flexible members causes the second end portion of the engine cable to actuate the resistance element.

19. The exercise machine of claim 18, wherein:

the actuation force causes at least one end portion of the first and second elongated flexible members to extend from an associated engagement point an extension distance; and the second end portion of the engine cable moves half the extension distance.

20. The exercise machine of claim 18, wherein the first end portion of the engine cable is repositionable to remove slack in the engine cable.

21. The exercise machine of claim 18, wherein the pulley system includes at least a first pulley structure and a second pulley structure connecting the first elongated flexible member and the second elongated flexible member, respectively, to the engine cable.

22. The exercise machine of claim 18, wherein the pulley system comprises at least three first pulley wheels and wherein the first elongated flexible member is routed around the at least three first pulley wheels.

23. The exercise machine of claim 22, wherein the pulley system comprises at least four second pulley wheels and wherein the second elongated flexible member is routed around the at least four second pulley wheels.

24. The exercise machine of claim 18, further comprising:

a third plurality of engagement points at a different elevation than the first and second plurality of engagement points; and a third elongated flexible member operably associated with the engine cable and including opposing end portions associated with and extending between one of the third plurality of engagement points and another engagement point not in the third plurality of engagement points.

25. The exercise machine of claim 24, wherein the pulley system comprises at least four pulley wheels and wherein the third elongated flexible member is routed around at least four pulley wheels of the pulley system.

26. The exercise machine of claim 18, wherein:

the pulley system includes a plurality of lifting pulleys associated with the first and second elongated flexible members; and the engine cable is operably associated with the first and second elongated flexible members through the plurality of lifting pulleys.

27. An exercise machine comprising:

a frame;

a resistance element;

a first plurality of engagement points operatively associated with the frame and comprising left and right engagement points at a first elevation a second plurality of engagement points operatively associated with the frame and comprising left and right engagement points at a second elevation different than the first elevation;

first and second elongated flexible members routed through a pulley system operatively associated with the frame; and an engine cable operably associated with the first and second elongated flexible members and including opposing first and second end portions, the first end portion being fixed, and the second end portion connected to the resistance element, wherein movement of at least one of the first and second elongated flexible members causes the second end portion of the engine cable to actuate the resistance element; and wherein:

the first elongated flexible member is operably associated with the resistance element and includes a first end portion associated with the left engagement point of the first plurality of engagement points and a second end portion associated with the right engagement point of the second plurality of engagement points, and the first elongated flexible member extends between the left engagement point of the first plurality of engagement points and the right engagement point of the second plurality of engagement points;

the second elongated flexible member is operably associated with the resistance element and includes a first end portion associated with the right engagement point of the first plurality of engagement points and a second end portion associated with a left engagement point not in the first plurality of engagement points, and the second elongated flexible member extends between the right engagement point of the first plurality of engagement points and the left engagement point not in the first plurality of engagement points;

the first end portion of the first elongated flexible member is joined to a first exercise attachment, and the second end portion of the first flexible member is joined to a second exercise attachment;

application of an actuation force to either of the first exercise attachment or the second exercise attachment extends the respective one of the first end portion of the first elongated flexible member or the second end portion of the first flexible member away from the associated left engagement point or right engagement point of the first and second plurality of engagement points and actuates the resistance element; and the actuation force causes at least one end portion of the first and second elongated flexible members to extend from an associated engagement point an extension distance, and the second end portion of the engine cable moves half the extension distance.

28. The exercise machine of claim 27, wherein the pulley system includes at least a first pulley structure and a second pulley structure connecting the first elongated flexible member and the second elongated flexible member, respectively, to the engine cable.

29. The exercise machine of claim 27, wherein the pulley system comprises at least three first pulley wheels and wherein the first elongated flexible member is routed around the at least three first pulley wheels.

30. The exercise machine of claim 29, wherein the pulley system comprises at least four second pulley wheels and wherein the second elongated flexible member is routed around the at least four second pulley wheels.

31. The exercise machine of claim 27, further comprising:

a third plurality of engagement points at a different elevation than the first and second plurality of engagement points; and a third elongated flexible member operably associated with the engine cable and including opposing end portions associated with and extending between one of the third plurality of engagement points and another engagement point not in the third plurality of engagement points.

* * * * *